US005847504A

United States Patent [19]

Baldi

[11] Patent Number: 5,847,504

[45] Date of Patent: Dec. 8, 1998

[54] FIELD EMISSION DISPLAY WITH DIODE-LIMITED CATHODE CURRENT

[75] Inventor: Livio Baldi, Agrate Brianza, Italy

[73] Assignee: SGS-Thomson Microelectronics, S.r.L., Agrate Brianza, Italy

[21] Appl. No.: 690,895

[22] Filed: Aug. 1, 1996

[30] Foreign Application Priority Data

Aug. 1, 1995 [EP] European Pat. Off. ..... 95830350

[51] Int. Cl.[6] ..... H01J 1/62; H01J 63/04; H01J 1/02; H01J 1/16

[52] U.S. Cl. ..... 313/495; 313/309; 313/336; 313/351

[58] Field of Search ..... 313/309, 336, 313/351, 346 R, 495; 445/50–51

[56] References Cited

U.S. PATENT DOCUMENTS

| | | | |
|---|---|---|---|
| 3,882,355 | 5/1975 | DeWitt . | |
| 4,513,308 | 4/1985 | Greene et al. . | |
| 5,162,704 | 11/1992 | Kobori et al. . | |
| 5,572,041 | 11/1996 | Betsui et al. | 313/309 |
| 5,656,886 | 8/1997 | Westphal et al. | 313/309 X |
| 5,688,707 | 11/1997 | Lee et al. | 437/51 |

FOREIGN PATENT DOCUMENTS

| | | |
|---|---|---|
| 0461990 | 12/1991 | European Pat. Off. . |
| 0496572 | 7/1992 | European Pat. Off. . |
| 0651417 | 5/1995 | European Pat. Off. . |
| 2650119 | 1/1991 | France . |

*Primary Examiner*—Nimeshkumar Patel
*Assistant Examiner*—Mark Haynes
*Attorney, Agent, or Firm*—Allen, Dyer, Doppelt, Milbrath & Gilchrist, P.A.

[57] ABSTRACT

A pixel emission current limiting resistance is realized by forming a stack of alternately doped amorphous or polycrystalline silicon layers over the cathodic conductors of a FED driving matrix. The stack of amorphous or polycrystalline silicon layers doped alternately n and p provides at least a reversely biased n/p junction having a leakage current that matches the required level of pixel emission current. The reversely biased junction constitutes a nonlinear series resistance that is quite effective in limiting the emission current through any one of the microtips that form an individually excitable pixel and which are formed on the uppermost layer of the stack.

47 Claims, 3 Drawing Sheets

FED Display Functional Block Diagram

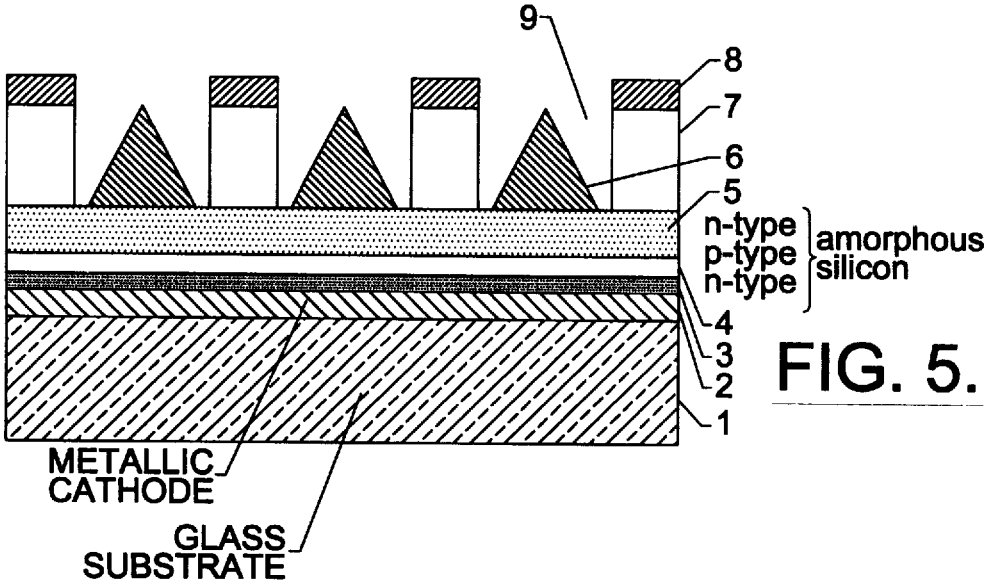
FIG. 5.
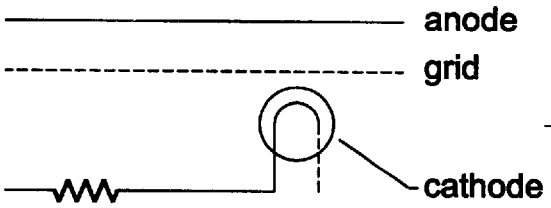
FIG. 6a.
FIG. 6b.
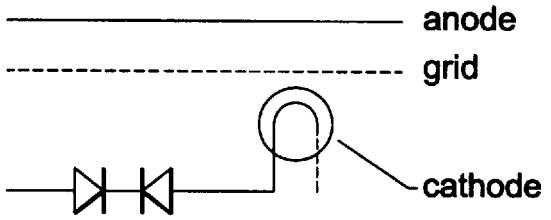

FIELD EMISSION DISPLAY WITH DIODE-LIMITED CATHODE CURRENT

CROSS-REFERENCE TO RELATED APPLICATION

This application claims priority from EP 95830350.5, filed Aug. 1, 1995, which is hereby incorporated by reference. However, the content of the present application is not necessarily identical to that of the priority application.

BACKGROUND AND SUMMARY OF THE INVENTION

This invention relates to a device for limiting and making uniform the current through microtips of a cathodic structure for flat panel displays (FPD) of the field emission type (FED).

The continuous evolution towards portable electronic products such as laptop computers, personal organizers, pocket TVs and electronics games, has created an enormous market for monochromatic or color display screens of small dimensions and reduced thickness, having a light-weight and a low dissipation. Especially the first two requirements cannot be met by conventional cathode ray tubes (CRTs). For this reason, among the emerging technologies, let alone those related to liquid-crystal-displays (LCD), flat panel field emission display technology has been receiving increasing attention by the industry.

A remarkable research and development work has been carried out in the past few decades on field emission displays (FED) employing a cathode in the form of a flat panel provided with a dense population of emitting microtips co-operating with a grid-like extractor essentially coplanar to the apexes of the microtips. The cathode-grid extractor structure is a source of electrons that are accelerable in a space, evacuated for ensuring an adequate mean free-path, towards a collector (anode) constituted by a thin and transparent conductor film upon which are placed luminescent phosphors excited by the impinging electrons. Emission of electrons is modulately excitable pixel by pixel through a matrix of columns and rows, constituted by parallel strips of said population of microtips and parallel strips of said grid-like extractor, respectively. The fundamental structure of these display systems and the main problems related to the fabrication technology, reliability and durability, as well as those concerning the peculiar way of exciting individual pixels of the display system and various proposed solutions to these problems, are discussed and described in a wealth of publications on these topics. Among the pertinent literature the following publications may be cited: U.S. Pat. Nos. 5,391,259 of Cathey et al.; 5,387,844 of Browning; 5,357,172 of Lee et al.; 5,210,472 of Casper, et al.; 5,194,780 of Meyer; 5,164,704 of Kobori et al.; 5,064,396 of Spindt; 4,940,916 of Borel et al.; 4,857,161 of Borel et al.; 4,513,308; 3,875,442 of Wasa, et al.; 3,812,559 of Spindt, et al.; 3,755,704 of Spindt et al.; 3,655,241 of Spindt et al.; "Beyond AMLCDs: Field emission displays?", K. Derbyshire, Solid State Technology, November 1994; "The state of the Display", F. Dawson, Digital Media, February–March 1994; "Competitive Display Technologies", 1993, Stanford Resources, Inc.; "Field-Emission Display Resolution", W. D. Kesling, et al., University of California, SID 93 DIGEST 599–602; "Phosphors For Full-Color Microtips Fluorescent Displays", F. Lévy, R. Meyer, LETI—DOFT SCMM, IEEE 1991, pages 20–23; "Diamond-based field emission flat panel displays", N. Kumar, H. Schmidt, Solid State Technology , May 1995, pages 71–74; "Electron Field Emission from Amorphic Diamond Thin Films", Chenggang Xle, et al., Microelectronics and Computer Technology Corporation, Austin, Tex.; University of Texas and Dallas, Richardson, Tex.; SI Diamond Technology, Inc., Houston, Tex.; "Field Emission Displays Based on Diamond Thin Films", Natin Kumar, et al:, Microelectronics and Computer Technology Corporation, Austin, Tex.; Elliot Schlam Associates, Wayside, N.J.; SI Diamond Technology, Inc., Houston, Tex.; "U.S. Display Industry on the Edge", Ken Werner, Contributing Editor, IEEE Spectrum, May 1995; "FEDs: The sound of silence in Japan", OEM Magazine, April 1995, pages 49, 51; "New Structure Si Field Emitter Arrays with low Operation Voltage", K. Koga, et al., 2.1.1, IEDM 94-23. All of the above references are hereby incorporated by reference.

The major advantages of FEDs compared to modern LCDs are:

low dissipation;

same color quality of traditional CRTs;

visibility from any viewing angle.

FED technology has developed itself on the basic teachings contained in U.S. Pat. Nos. 3,665,241; 3,755,704 and 3,812,559 of C. A. Spindt and in U.S. Pat. No. 3,875,442 of K. Wasa, et al., all of which are hereby incorporated by reference.

FED technology connects back to conventional CRT technology, in the sense that light emission occurs in consequence of the excitation of the phosphors deposited on a metallized glass screen bombarded by electrons accelerated in an evacuated space. The main difference consists in the manner in which electrons are emitted and the image is scanned.

A concise but thorough account of the state of modern FED technology is included in a publication entitled "Competitive Display Technologies—Flat Information Displays" by Stanford Resources. Inc., Chapter B "Cold Cathode Field Emission Displays", which is hereby incorporated by reference. A schematic illustration contained in said publication and giving a comparison between a conventional CRT display and a FED (or FED array) is herein reproduced in FIG. 1. In a traditional CRT there is a single cathode in the form of an electron gun (or a single cathode for each color) and magnetic or electrostatic yokes deflect the electron beam for repeatedly scanning the screen, whereas in a FED the emitting cathode is constituted by a dense population of emission sites distributed more or less uniformly over the display area. Each site is constituted by a microtip electrically excitable by means of a grid-like extractor. This flat cathode-grid assembly is set parallel to the screen, at a relatively short distance from it. The scanning by pixel of the display is performed by sequentially exciting individually addressable groups of microtips by biasing them with an adequate combination of grids and cathode voltages.

As shown in FIG. 2, a certain area of the cathode-grid structure containing a plurality of microtips and corresponding to a pixel of the display is sequentially addressed through a driving matrix organized in rows and columns (in the form of sequentially biasable strips, into which the cathode is electrically divided and of sequentially biasable strips into which the grid extractor is electrically divided, respectively).

A typical scheme of the driving by pixel of the cathodic structure of a FED is shown in FIG. 3. This figure illustrates the driving scheme of a fragment of nine adjacent pixels through a combination of the sequential row biasing pulses for the three rows R1, R2, R3, relative to a certain bias configuration of the three columns C1, C2 and C3.

A typical cross-sectional view of a FED structure is shown in FIG. 4.

The microtip cathode plate generally comprises a substrate of an isolating material such as glass, ceramic, silicon (GLASS BACKPLATE), onto which is deposited a low resistivity conductor layer as for example a film of aluminum, niobium, nickel or of a metal alloy (NICKEL ELECTRODE), eventually interposing an adhesion layer for example of silicon (SILICON FILM) between the substrate and the conductor layer. The conductor layer (NICKEL ELECTRODE) is photolithographically patterned into an array of parallel strips each constituting a column of a driving matrix of the display. A dielectric layer, for example of an oxide (SILICON DIOXIDE), is deposited over the patterned conductor layer. A conductor layer (NIOBIUM GATE METAL), from which the grid extractor will be patterned, is deposited over the dielectric layer. The grid structure is eventually defined in parallel strips, normal to the cathode parallel strips (NICKEL ELECTRODE). According to a known technique, microapertures or wells that reach down to the surface of the underlying patterned conductor layer (NICKEL ELECTRODE) are defined and cut through the grid conductor layer (NIOBIUM GATE METAL) and through the underlying dielectric layer (SILICON DIOXIDE). Onto the surface of the conductor layer exposed at the bottom of the "wells", are fabricated microtips (MOLYBDENUM MICROTIPS) that will constitute as many sites of emission of electrons. On the inner face of a glass faceplate of the display is deposited a transparent thin conducting film, for example of a mixed oxide of indium and tin (ITO CONDUCTOR) upon which is deposited a layer of phosphors (monochromatic phosphor or color phosphors) excitable by the electrons accelerated toward the conducting layer (ITO CONDUCTOR) acting as a collector of the electrons emitted by the microtips. Emission that is stimulated by the electric field produced by suitably biasing the grid conductor and the cathode tips.

In order to improve color resolution, the realization of a "switched" anodic (collector) structure for separately biasing adjacent strips, each covered with a phosphor of a different basic color, has been suggested in a publication entitled: "Phosphors For Full-Color Microtips Fluorescent Displays" by F. Levy and R. Mayer, of LETI-DOFT-SCMM, Grenoble, France.

Fabricating processes of microtips cathode plates are described in U.S. Pat. Nos. 4,857,161; 4,940,916; 5,194,780 and 5,391,259, all of which are hereby incorporated by reference.

In general there exist a well recognized problem of ensuring an uniform luminance (brightness) of the display that involves a control of the emission current of each single microtip (commonly in the order of several hundreds) that belong to a singularly addressable pixel (area) of the display.

While on one hand an intervening reduction of the emission efficiency of single tips is not in itself a cause of failure in view of the fact that each pixel is constituted by a multiplicity of microtips working in parallel, on the other hand, the presence of microtips having an emission efficiency much higher than average is particularly detrimental, because of the following effects:

a) screen faults in the form of intensely bright spots;

b) (in extreme cases) severe damage to the panel by evaporation of the tip and of the adjoining grid.

Essentially the current emitted by each single tip depends on two factors:

i) the radius of curvature of the microtip which depends on the fabrication technique;

ii) the electric field at the vertex of the microtip that depends on the distance between the tip and the adjoining grid.

Both these geometric parameters depend on the process of fabrication and therefore present a certain statistic dispersion (spread). Another problem is tied to the ageing of the display, that is, the reduction of the luminance resulting from a progressive reduction of the phosphors' efficiency. This ageing process is closely connected to the electronic bombardment and therefore tends to become faster in correspondence of bright spots and is generally faster the higher is the initial pixel current.

The problem of nonuniformity is well recognized in the literature on the subject and various solutions have so far been put forward.

A) External resistors can be connected in series with each column of the display for limiting the maximum current by causing a certain voltage drop. In view of the fact that the microtip current is a rapidly increasing function of the electric field, the effect of this resistance is that of limiting the current swing. However, this solution can only be applied to displays of a limited size because of the delays that are inevitably induced by the combination of the increased series resistance and the column's capacitance.

B) The microtips can be fabricated in the form of pillars having a first base layer (plinth) made of a relatively high resistivity material. This solution which is described in the U.S. Pat. No. 3,789,471, which is hereby incorporated by reference, is theoretically very efficient though high currents may cause the explosion of the tip because of a reduced ability to dissipate heat.

C) An active element, for example a diode connected JFET or MOSFET can be realized in the substrate, in series with each tip or plurality of tips corresponding to a pixel of the display, as described in the U.S. Pat. Nos. 5,210,472; 5,357,172; 5,387,844 and in the patent application Ser. No. 08/077,181 (WO 94/14182), all of which are hereby incorporated by reference. However, this approach requires the realization of active elements in the substrate leading to remarkable technological problems and tends to increase markedly the fabrication costs.

D) A resistive layer, usually constituted by a suitably doped amorphous or partially polycrystalline silicon, can be interposed between an underlying conductive layer that defines the columns and the microtips as described in the U.S. Pat. No. 4,940,916 and in the publication: "Current limiting of field emitter array cathodes" by K. J. Lee, Un. of Georgia, all of which are hereby incorporated by reference. In this case, the resistance is in series with each group of microtips that form a pixel (thus reducing delay problems) and is constituted by a continuous layer (thus reducing the problems connected to heat dissipation).

The above mentioned approach is currently regarded as the most promising, although it has some drawbacks:

i) it is extremely difficult to control the resistivity of amorphous and/or polycrystalline silicon layers because resistivity critically depends on the grain boundary structure and/or on the superficial states of the structure;

ii) the electrical resistance of the current path perpendicular to the layer can be insufficient unless the thickness of the resistive layer is markedly increased;

iii) in the specific case of microtips obtained by etching a matrix layer of doped amorphous or polycrystalline silicon, as described in the U.S. Pat. No. 5,391,259, which is hereby incorporated by reference, the resistance will depend critically on the residual thickness of the silicon layer which might present large variations across the surface of the panel.

Item ii) has been partially overcome by realizing the cathode in a grating-like form as described in the U.S. Pat. No.

5,194,780, which is hereby incorporated by reference. This solution however, brings about further complexities to the fabrication process and does not overcome the problems mentioned in i) and iii) above.

The present application provides a field emission display which uses a reverse-biased diode structure to limit the cathode current of the display driver. According to a preferred embodiment, a pixel emission current limiting resistance is realized by forming a stack of alternately doped amorphous or polycrystalline silicon layers over the cathodic conductors of a FED driving matrix. The stack of amorphous or polycrystalline silicon layers doped alternately n and p provides at least a reversely biased n/p junction having a leakage current that matches the required level of pixel emission current. The reversely biased junction constitutes a nonlinear series resistance that is quite effective in limiting the emission current through any one of the microtips that form an individually excitable pixel and which are formed on the uppermost layer of the stack.

BRIEF DESCRIPTION OF THE DRAWING

The disclosed inventions will be described with reference to the accompanying drawings, which show important sample embodiments of the invention and which are incorporated in the specification hereof by reference, wherein:

FIG. 5 shows the microsection of a cathodic structure made according to this invention;

FIGS. 6*a* and 6*b* compare the electric supply scheme, referred to a single pixel, of a microtip cathodic structure made according to the prior art and to the present invention, respectively.

DETAILED DESCRIPTION OF THE PREFERRED EMBODIMENTS

Figure 1:
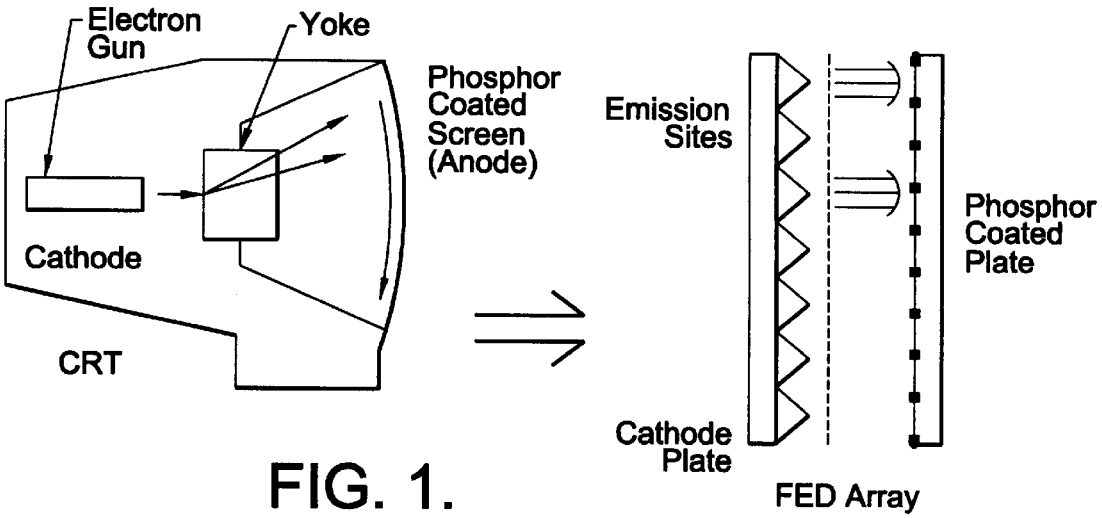
FIG. 1. (PRIOR ART)
FIG. 1 is a general comparative scheme between a conventional CRT display device and a field emission flat array display device (FED)
Figure 2:
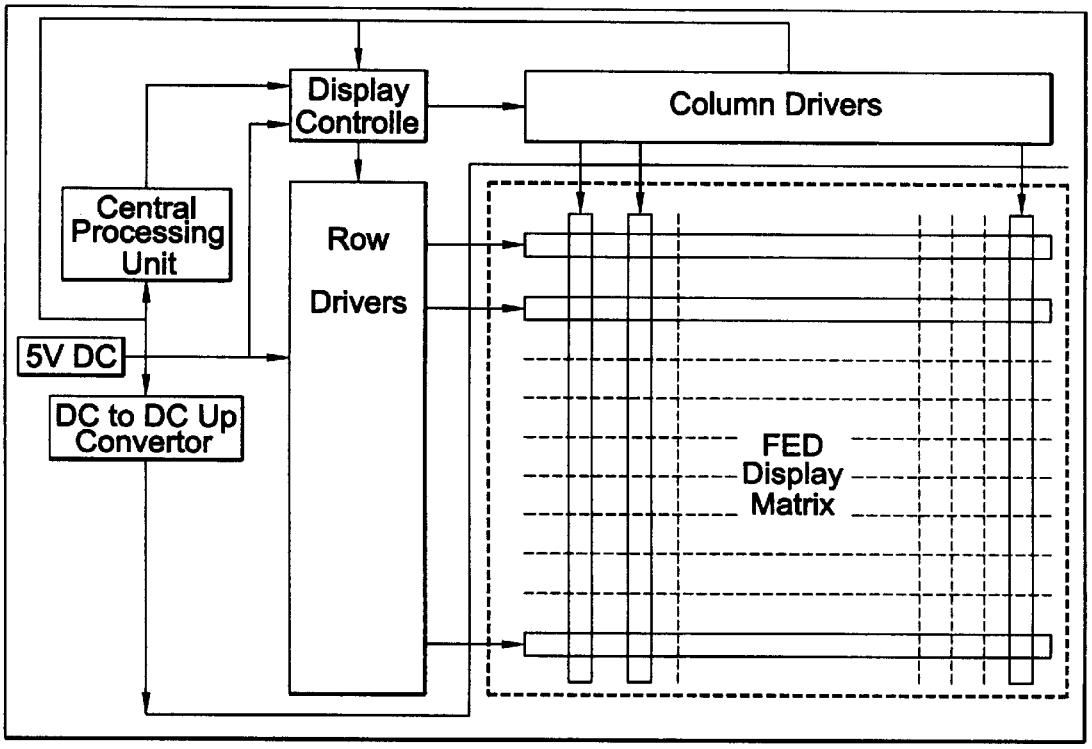
FIG. 2. (PRIOR ART)
FIG. 2 shows the general architecture of a FED device and of the relative driving circuitry.
Figure 3:
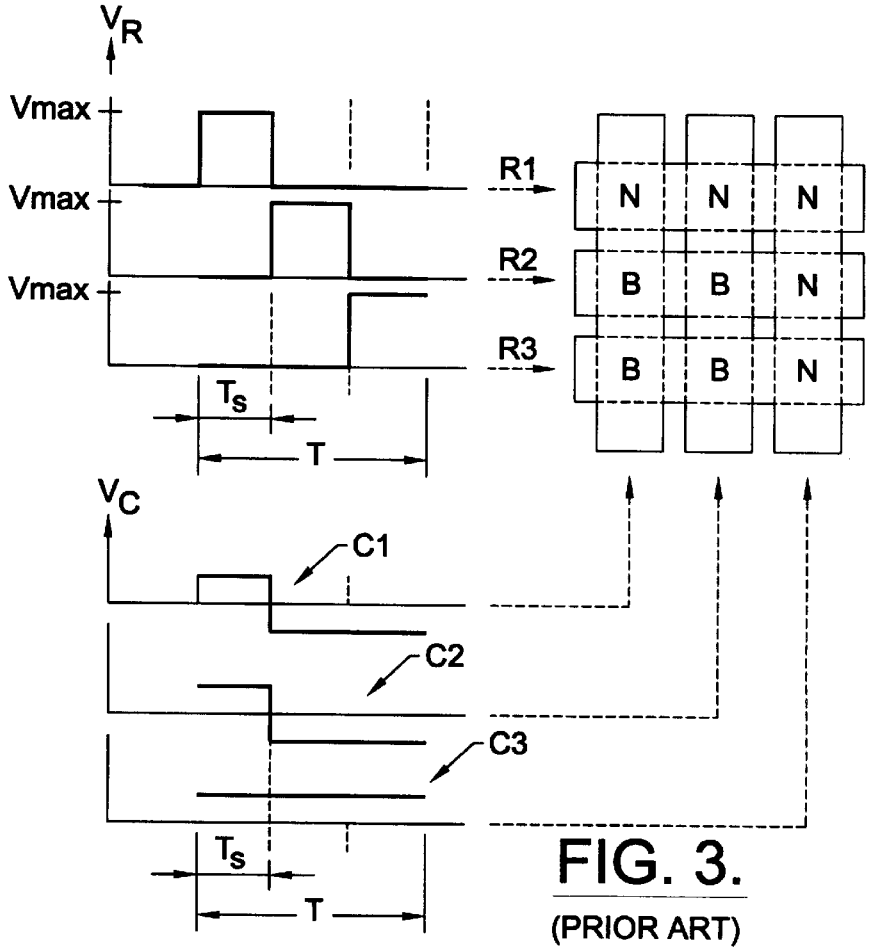
FIG. 3. (PRIOR ART)
FIG. 3 is an illustration of how every single pixel of a FED device is driven.

The numerous innovative teachings of the present application will be described with particular reference to the presently preferred embodiment (by way of example, and not of limitation), in which:

With reference to FIG. 5, a microtip cathodic structure is realized on a substrate 1 of a suitable insulating material, such as glass, ceramics, silicon and the like (GLASS SUBSTRATE). With or without the interposition of an adhesion layer, for example of silicon, over one (inner side) face of the substrate a conductor layer 2 of low resistivity, for example a layer of aluminum, niobium, nickel or a metal alloy (METALLIC CATHODE) is eventually deposited. The conductor layer may have a thickness comprised within 0.3 and 0.8 $\mu$m. The metallic layer 2 can be deposited by sputtering or by any other suitable technique.

According to this invention the amorphous silicon stack is preferably deposited by plasma-enhanced chemical vapor phase deposition (PECVD) or at least the first two layers 2 and 4 of the stack are preferably deposited using this technique that ensures a good control of the deposition even at a relatively high rate of deposition and under conditions of relatively low temperature.

The third or topmost layer 5 may be deposited by PECVD or, in the case the microtips are obtained from such a polycrystalline and/or amorphous silicon upper layer 5, said layer that must be deposited with an adequately large thickness, may be formed by other deposition techniques even though the PECVD process is regarded as preferable.

The triple layer or stack (3, 4 and 5) of amorphous, partially polycrystalline or eventually polycrystalline silicon can be alternately doped to realize an n-p-n stack, as in the example illustrated in FIG. 5, or a p-n-p stack.

Of paramount importance is the alternance of the type of conductivity of the three superimposed layers so as to realize a double (back-to-back) junction, one junction of which is always inversely biased, regardless of the polarity of the voltage applied to the cathodic structure through the control matrix, which matrix consists of rows (strips) of grid electrode and of columns (strips) in which is electrically subdivided the cathodic structure.

With reference to the example of FIG. 5, the first layer 3 of n-doped polycrystalline and/or amorphous silicon, may have the following characteristics:

thickness: from 0.3 to 0.1 $\mu$m;

concentration of dopant: from $10^{19}$ to $5 \cdot 10^{20}$;

the intermediate p-doped layer 4 should guarantee that the electric structure constituted by the double junction p-n-p (or n-p-n) has a breakdown voltage higher than the grid voltage and for this reason it should have a lower doping level lower than both the bottom and top layer, in practice it may have the following characteristics:

thickness from 0.5 to 1.0 $\mu$m;

concentration of dopant: from $10^{15}$ to $5 \cdot 10^{16}$;

the third or upper n-doped layer 5, may have the following characteristics:

thickness: from 0.5 to 1.0 $\mu$m;

concentration of dopant: from $10^{19}$ to $5 \cdot 10^{20}$.

The above mentioned ranges of variation of the characteristics of the amorphous and/or polycrystalline superimposed layers of alternately doped silicon are purely an indication of conditions that are considered suitable for obtaining an enhanced limiting and uniforming of the emission current through the microtips of an addressable pixel of the display. Of course, the most adequate thickness and the most adequate level of doping may be determined by a "trial and error" procedure for optimizing the performance of the cathodic depending on other parameters of the panel architecture on the process of fabrication used and on the dimensions and characteristics of the display.

Of course, when the microtips 6 are formed by etching an upper layer of silicon that may be the top layer 5 of the stack, the thickness of the latter will have to be adequately increased by an amount equal to or modulately larger than the height of the microtips to be formed.

According to the example illustrated in FIG. 5, the microtips are obtained by vertical sputtering a refractory metal, for example molybdenum, inside performed wells 9 created by a dedicated photolithographic step for patterning the stack that includes a dielectric isolation layer of adequate thickness 7, typically of silicon dioxide, and a conductive layer 8, typically of niobium or of a metal alloy of nickel and niobium from which the extractor grid of the cathode structure is defined.

According to the architecture illustrated in the example of FIG. 5, the thickness of the upper layer 5 of the stack may be designed in function of the actual "resistivity" of the inversely biased junction of the triple layer of the alternately doped amorphous and/or polycrystalline silicon (3, 4 and 5)

(n-p-n, as in the example shown, or p-n-p) in order to foster an enhanced uniformity of the emission currents through all the tips of a selected pixel. In practice, the lateral resistance through the upper layer 5, onto which the microtips are formed, as referred to the pixel dimensions, should be preferably lower than the series resistance along the path of the emission current that is provided by the inversely biased junction extending throughout the area of the selected pixel.

The possibility of freely increasing the conductivity of the upper layer 5 over which or from the face of which the microtips 6 extend, either by adjusting the doping level or increasing the thickness of the upper layer 5, permits to ensure a high degree of bias uniformity over the whole pixel area and a good heat dissipation, whereas an effective limitation of the pixel current is ensured by the series resistance provided by the inversely biased junction, having a sufficiently high leakage current, constituted by the superimposition of alternately doped n and p layers of polycrystalline and/or amorphous silicon. This results in an outstanding controllability of the characteristics and performances of the fabricated panel.

Figure 4:
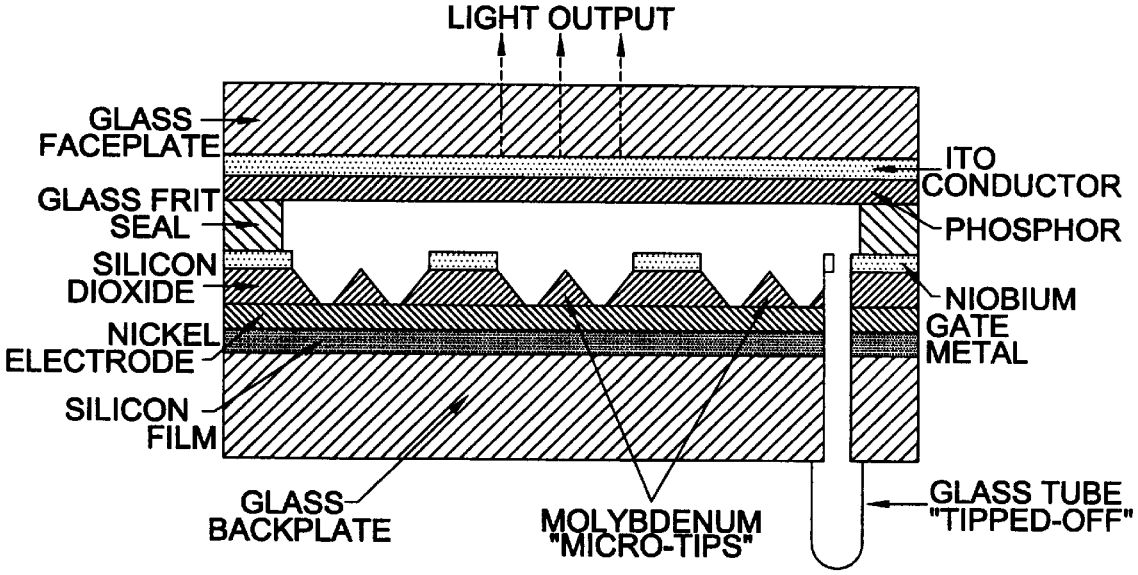
FIG. 4. (PRIOR ART)
FIG. 4 is a schematic cross sectional illustration of the structure of a FED device.

The innovative structure is ideal for use in an FED system, including the glass faceplate, seal, phosphor, and ITO conductor as described and shown in FIG. 4. In a preferred FED display system, a vacuum is maintained in the range of $10^{-10}$ to $10^{-7}$ Torr, with a typical value of $10^{-8}$ Torr.

According to one disclosed class of innovative embodiments, there is provided: a field emission display comprising populations of cathodic microtips over conductive strips defined on the surface of a dielectric substrate and constituting as many columns individually biasable by a column scanning drive circuitry of a pixel addressing matrix comprising conductive grid strips, orthogonal to said columns, having populations of holes co-operating with said populations of microtips and individually biasable by a row selection circuitry of said matrix characterized in that each of said conductive strips defined on the surface of the dielectric substrate comprises a multilayer or stack formed by at least three superimposed layers of amorphous and/or polycrystalline silicon, each layer being doped to have an alternate type of conductivity; said multilayer allowing the passage of a current therethrough in the form of a leakage current of an inversely biased n-p junction between two of said alternately n or p doped layers.

According to another disclosed class of innovative embodiments, there is provided a method of limiting the current emitted by microtips of a cathodic structure of a field emission display characterized by realizing between a conductive strip of a pixel driving matrix and over which a population of emitting microtips is formed, at least an inversely biased junction in the form of superimposed layers of alternately doped amorphous and/or polycrystalline silicon.

According to another disclosed class of innovative embodiments, there is provided a field-emission cathodic structure, comprising a substrate bearing an array of electron emitter structures; and connections for applying voltage to one or more selected ones of said vacuum emitter structures to induce emission therefrom; each said emitter structure overlying a current-limiting structure which includes at least one diode formed at least partly from non-monocrystalline semiconductor material, said diode being connected to be reverse-biased when electrons flow to said emitter.

According to another disclosed class of innovative embodiments, there is provided a field-emission display, comprising a substrate bearing an array of electron emitter structures; and connections for applying voltage to one or more selected ones of said vacuum emitter structures to induce emission therefrom; each said emitter structure overlying a current-limiting structure which includes at least one diode formed at least partly from non-monocrystalline semiconductor material, said diode being connected to be reverse-biased when electrons flow to said emitter; and a faceplate overlying said substrate to form a sealed chamber which houses said vacuum emitted structures.

According to another disclosed class of innovative embodiments, there is provided a field-emission cathodic structure, comprising a substrate bearing an array of electron emitter structures in rows and columns; cathode connections for selectably applying voltage to respective back surfaces of said emitter structures in selected rows of said array; grid connections for selectably applying voltage to respective front surfaces of said emitter structures in selected columns of said array, to induce emission from ones of said emitter structures which lie in a selected row and in a selected column; each said emitter structure overlying a distributed current-limiting structure which includes at least one diode formed at least partly from non-monocrystalline semiconductor material, said diode being connected to be reverse-biased when electrons flow to said emitter.

According to another disclosed class of innovative embodiments, there is provided a field-emission cathodic structure, comprising: a substrate bearing an array of electron emitter structures in rows and columns; cathode connections for selectably applying voltage to respective back surfaces of said emitter structures in selected rows of said array; grid connections for selectably applying voltage to respective front surfaces of said emitter structures in selected columns of said array, to induce emission from ones of said emitter structures which lie in a selected row and in a selected column; each said emitter structure overlying a distributed current-limiting structure which includes at least one diode formed at least partly from non-monocrystalline semiconductor material, said diode being connected to be reverse-biased when electrons flow to said emitter; and a faceplate overlying said substrate to form a sealed chamber which houses said vacuum emitted structures.

According to another disclosed class of innovative embodiments, there is provided a field-emission cathodic structure, comprising: a substrate bearing an array of electron emitter structures in rows and columns; cathode connections for selectably applying voltage to respective back surfaces of said emitter structures in selected rows of said array; grid connections for selectably applying voltage to respective front surfaces of said emitter structures in selected columns of said array, to induce emission from ones of said emitter structures which lie in a selected row and in a selected column; each said emitter structure overlying a distributed current-limiting structure which includes back-to-back diodes including at least one junction diode formed entirely from non-monocrystalline semiconductor material; a faceplate overlying said substrate to form a sealed chamber which houses said vacuum emitted structures.

According to another disclosed class of innovative embodiments, there is provided a method for fabricating a field-emission cathodic structure, comprising the steps of: (a) providing a substrate; (b) forming thin-film metallic cathode driver lines above said substrate; (c) forming a current-limiting structure overlying said cathode driver lines, said current-limiting structure including back-to-back diodes having at least two oppositely-doped layers formed from non-monocrystalline semiconductor material; and (d) forming field-emission emitter structures over said current-limiting structure.

According to another disclosed class of innovative embodiments, there is provided a method for fabricating a field-emission cathodic structure, comprising the steps of: (a) providing a substrate; (b) forming thin-film metallic cathode driver lines above said substrate; (c) forming a current-limiting structure overlying said cathode driver lines, said current-limiting structure including back-to-back diodes having at least two oppositely-doped layers formed from non-monocrystalline semiconductor material; and (d) forming field-emission emitter structures over said current-limiting structure; (e) providing rows of conductive extractor strips over said current limiting structures; wherein said driver lines are organized into columns orthogonal to said rows.

According to another disclosed class of innovative embodiments, there is provided a method for operating a field-emission cathodic structure which includes a plurality of microtip emitters, comprising the steps of: (a) applying a drive voltage to at least one said emitter, to emit electrons; and (b) during said step (a), using a back-to-back non-crystalline diode structure to regulate current through said microtip emitter; and (c) repeating said step (a) for multiple pixels of the display; whereby said step (b) limits and equalizes the current passed by said emitters.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, the disclosed emitter structure can also be used, alternatively and less preferably, for vacuum-fluorescent displays. For another example, this structure is not limited to a standard field emission display, but may also be used for flat-panel display illumination. For another example, the innovative cathode stucture may also be applied to microtip field-emission power devices. For another example, in a less preferred embodiment, the npn stack may also be patterned.

What is claimed is:

1. A field emission display comprising a plurality of cathodic microtips over conductive strips defined on the surface of a dielectric substrate and constituting as many columns individually biasable by a column scanning drive circuitry of a pixel addressing matrix comprising conductive grid strips, orthogonal to said columns, having a plurality of holes cooperating with said populations of microtips and individually biasable by a row selection circuitry of said matrix wherein each of said conductive strips defined on the surface of the dielectric substrate comprises a stack formed by at least three superimposed layers, each formed alike of one of amorphous or polycrystalline silicon, each layer being doped to have an alternate type of conductivity of alternate n and p conductivity to form a double back-to-back junction, one junction which is always inversely biased;

said multilayer allowing the passage of a current therethrough in the form of a leakage current of an inversely biased n-p junction between two or said alternately n or p doped layers wherein said leakage current matches a required level of pixel emission current.

2. The field emission display as defined in claim 1, wherein said inversely biased n-p junction has an emission current path normal to said layers and that is substantially more resistive than a lateral path through the uppermost one of said layers relative to the lateral dimensions of the area of any single pixel of the display containing a plurality of said microtips.

3. The field emission display as defined in claim 1, wherein said three superimposed layers have respectively an n, p, and n type of conductivity.

4. The field emission display as defined in claim 1, wherein said three superimposed layers have respectively a p, n, and p type of conductivity.

5. The field emission display as defined in claim 1, characterized in that the intermediate layer of said stack of three superimposed layers has a concentration of dopant lower than the concentration of dopant of the other two layers.

6. The field emission display as defined in claim 1, wherein said three superimposed layers are of substantially amorphous silicon.

7. The field emission display as defined in claim 1, wherein said three superimposed layers are of polycrystalline silicon.

8. The field emission display as defined in claim 7, wherein said three superimposed layers of doped polycrystalline silicon have a grain size allowing a relatively high level of leakage current across said inversely biased junction to match the required level of emission current level through said microtips.

9. A method of limiting the current emitted by microtips of a cathodic structure of a field emission display characterized by realizing between a conductive strip of a pixel driving matrix and over which a population of emitting microtips is formed, at least an inversely biased junction in the form of superimposed layers, each formed alike of one of amorphous or polycrystalline silicon wherein each layer has been alternately doped to have an alternate type of conductivity of alternate n and p conductivity to form a double back-to-back junction, one junction which is always inversely biased, to allow the passage of a current therethrough in the form of a leakage current of an inversely biased n-p junction between two of the alternately n or p doped layers, wherein the leakage current matches a required level of pixel emission current.

10. A field emission cathodic structure comprising:

a substrate bearing an array of electron emitter structures and having a required level of pixel emission current; and connections for applying voltage to one or more selected ones of said vacuum emitter structures to induce emission therefrom;

each said emitter structure overlying a current-limiting structure which includes at least one diode formed at least partly from non-monocrystalline semiconductor material, said diode being connected to be reverse-biased when electronics flow to said emitter and having a leakage current that matches the required level of pixel emission current.

11. A field emission display comprising:

a substrate bearing an array of electron emitter structure; and connections for applying voltage to one or more selected ones of said vacuum emitter structures to induce emission therefrom and having a required level of pixel emission current;

each of said emitter structure overlying a current-limiting structure which includes at least one diode formed at least partly from non-monocrystalline semiconductor material, said diode being connected to be reverse-biased when electrons flow to said emitter and having a leakage current that matches the required level of pixel emission current; and a faceplate overlying said substrate to form a sealed chamber which houses said vacuum emitter structures.

12. The field-emission display of claim 11, wherein said non-monocrystalline semiconductor material is amorphous silicon.

13. The field-emission display of claim 11, wherein said non-monocrystalline semiconductor material is polycrystalline silicon.

14. The field-emission display of claim 11, and further comprising metallic driver lines formed of aluminum.

15. The field-emission display of claim 11, wherein said current-limiting structure is PNP.

16. The field-emission display of claim 11, wherein said substrate is silicon.

17. A field-emission cathodic structure comprising:

a substrate bearing an array of electron emitter structures in rows and columns and having a required level of pixel emission current;

cathode connections for selectably applying voltage to respective back surfaces of said emitter structures in selected rows of said array and having a leakage current that matches the required level of pixel emission current.

18. The field-emission cathodic structure of claim 17, wherein said non-monocrystalline semiconductor material is amorphous silicon.

19. The field-emission cathodic structure of claim 17, wherein said non-monocrystalline semiconductor material is polycrystalline silicon.

20. The field-emission cathode structure of claim 17, and further comprising metallic driver lines formed of aluminum.

21. The field-emission cathodic structure of claim 17, wherein said current-limiting structure is PNP.

22. The field-emission cathodic structure of claim 17, wherein said substrate is silicon.

23. A field-emission cathodic structure comprising:

a substrate bearing an array of electron emitter structures in rows and columns;

cathode connections for selectably applying voltage to respective back surfaces of said emitter structures in selected rows of said array and having a required level of pixel emission current;

grid connections for selectably applying voltage to respective front surfaces of said emitter structures in selected columns of said array, to induce emission from ones of said emitter structures which lie in a selected row and in a selected column;

each said emitter structure overlying a distributed current-limiting structure which includes at least one diode formed at least partly from non-monocrystalline semiconductor material, said diode being connected to be reverse-biased when electrons flow to said emitter and having a leakage current that matches the required level of pixel emission current; and a faceplate overlying said substrate to form a sealed chamber which houses said vacuum emitted structures.

24. The field-emission cathodic structure of claim 23, wherein said non-monocrystalline semiconductor material is amorphous silicon.

25. The field-emission cathodic structure of claim 23, wherein said non-monocrystalline semiconductor material is polycrystalline silicon.

26. The field-emission cathode structure of claim 23, and further comprising metallic driver lines formed of aluminum.

27. The field-emission cathodic structure of claim 23, wherein said current-limiting structure is PNP.

28. The field-emission cathodic structure of claim 23, wherein said substrate is silicon.

29. A field-emission cathodic structure comprising:

a substrate bearing an array of electron emitter structures in rows and columns;

cathode connections for selectably applying voltage to respective back surfaces of said emitter structures in selected rows of said array and having a required level of pixel emission current;

grid connections for selectably applying voltage to respective front surfaces of said emitter structures in selected columns of said array, to induce emission from ones of said emitter structures which lie in a selected row and in a selected column;

each said emitter structure overlying a distributed current-limiting structure which includes back-to-back diodes including at least one junction diode formed entirely from non-monocrystalline semiconductor material and having a leakage current that matches the required level of pixel emission current; and a faceplate overlying said substrate to form a sealed chamber which houses said vacuum emitted structures.

30. The field-emission cathodic structure of claim 29, wherein said non-monocrystalline semiconductor material is amorphous silicon.

31. The field-emission cathodic structure of claim 29, wherein said non-monocrystalline semiconductor material is polycrystalline silicon.

32. The field-emission cathode structure of claim 29, and further comprising metallic driver lines formed of aluminum.

33. The field-emission cathodic structure of claim 29, wherein said current-limiting structure is PNP.

34. The field-emission cathodic structure of claim 29, wherein said substrate is silicon.

35. A method for fabricating a field-emission cathodic structure comprising the steps of:

a. providing a substrate;

b. forming thin-film metallic cathode driver lines above said substrate;

c. forming a current-limiting structure overlying said cathode driver lines, said current-limiting structure including back-to-back diodes having at least two oppositely-doped layers formed from non-monocrystalline semiconductor material having alternately doped n or p doped layers; and d. forming field-emission emitter structures over said current-limiting structure, wherein the current-limiting structure allows the passage of a current therethrough in the form of a leakage current of an inversely biased n-p junction between two of said alternately doped n or p doped layers, wherein the leakage current matches a required level of pixel emission current.

36. The method of claim 35, wherein said non-monocrystalline semiconductor material is amorphous silicon.

37. The method of claim 35, wherein said non-monocrystalline semiconductor material is polycrystalline silicon.

38. The method of claim 35, wherein said metallic cathode driver lines are aluminum.

39. The method of claim 35, wherein said current-limiting structure is PNP.

40. The method of claim 35, wherein said substrate is silicon.

41. A method for fabricating a field-emission cathodic structure comprising the steps of:

a. providing a substrate;

b. forming thin-film metallic cathode driver lines above said substrate;

c. forming a current-limiting structure overlying said cathode driver lines, said current-limiting structure including back-to-back diodes having at least two oppositely-doped layers formed from non-monocrystalline semiconductor material having alternately doped n or p layers; and d. forming field-emission emitter structures over said current-limiting structure;

e. providing rows of conductive extractor strips over said current limiting structures;

wherein said metallic driver lines are organized into columns orthogonal to said rows, wherein the current-limiting structure allows the passage of a current therethrough in the form of a leakage current of an inversely biased n-p junction between two of said alternately doped n or p doped layers, wherein the leakage current matches a required level of pixel emission current.

42. The method of claim 41, wherein said non-monocrystalline semiconductor material is amorphous silicon.

43. The method of claim 41, wherein said non-monocrystalline semiconductor material is polycrystalline silicon.

44. The method of claim 41, wherein said cathode metallic driver lines are aluminum.

45. The method of claim 41, wherein said current-limiting structure is PNP.

46. The method of claim 41, wherein said substrate is silicon.

47. A method for operating a field-emission cathodic structure which includes a plurality of microtip emitters comprising the steps of:

a. applying a drive voltage to at least one said emitter to emit electrons; and b. during said step (a), using back-to-back non-crystalline diode structure to regulate current through said microtip emitter; and c. repeating said step (a) for multiple pixels of the display;

whereby said step (b) limits and equalizes the current passed by said emitters, wherein the current-limiting structure allows the passage of a current therethrough in the form of a leakage current of an inversely biased n-p junction, wherein the leakage current matches a required level of pixel emission current.

* * * * *

UNITED STATES PATENT AND TRADEMARK OFFICE

CERTIFICATE OF CORRECTION

PATENT NO. : 5,847,504
DATED : December 8, 1998
INVENTOR(S) : BALDI

It is certified that error appears in the above-identified patent and that said Letters Patent is hereby corrected as shown below:

Column 5, Line 63 delete:
"two"

Insert:
- - three - -

Column 14, Lines 4-5 delete:
"cathode metallic driver"

Insert:
- - metallic cathode driver - -

Signed and Sealed this

Twenty-third Day of March, 1999

*Attest:*

Q. TODD DICKINSON

*Attesting Officer*

*Acting Commissioner of Patents and Trademarks*